US009541042B2

(12) United States Patent
Song

(10) Patent No.: US 9,541,042 B2
(45) Date of Patent: Jan. 10, 2017

(54) ENGINE HAVING OXYGEN PUMPING INTAKE SYSTEM AND METHOD OF REMOVING OXYGEN FROM INTAKE AIR FLOW

(75) Inventor: B. Jerry Song, Novi, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1831 days.

(21) Appl. No.: 12/400,294

(22) Filed: Mar. 9, 2009

(65) Prior Publication Data

US 2010/0223920 A1 Sep. 9, 2010

(51) Int. Cl.
*F01N 3/10* (2006.01)
*F02M 27/04* (2006.01)

(52) U.S. Cl.
CPC ..... *F02M 27/04* (2013.01)

(58) Field of Classification Search
USPC ..... 60/275; 123/343, 539, 704
See application file for complete search history.

(56) References Cited

U.S. PATENT DOCUMENTS 4,031,865 A * 6/1977 Dufour ..... 123/1 A
5,779,879 A 7/1998 Dieterich et al.
6,230,494 B1 * 5/2001 Botti et al. ..... 60/649
6,655,325 B1 * 12/2003 Botti et al. ..... 123/3
7,100,543 B2 9/2006 Davidson
7,632,588 B2 * 12/2009 Kawasaki et al. ..... 429/456
2004/0055586 A1 * 3/2004 Botti et al. ..... 123/585
2007/0215130 A1 * 9/2007 Shelby et al. ..... 123/637
2009/0139497 A1 * 6/2009 Shi et al. ..... 123/539

FOREIGN PATENT DOCUMENTS

DE 4404681 C1 5/1995
JP 02095765 A 4/1990

* cited by examiner

*Primary Examiner* — Kenneth Bomberg
*Assistant Examiner* — Jason Sheppard
(74) *Attorney, Agent, or Firm* — Harness, Dickey & Pierce, P.L.C.

(57) ABSTRACT

An engine assembly may include a voltage source and an oxygen pump assembly. The oxygen pump assembly may include an intake conduit and an oxygen pumping mechanism. The intake conduit may be in fluid communication with an air supply and an intake manifold. The oxygen pumping mechanism may include an oxygen ion conducting cell, a first electrode in electrical communication with the voltage source and a second electrode in electrical communication with the voltage source. The first electrode may be disposed on a first side of the cell and may be exposed to an interior of the intake conduit. The second electrode may be disposed on a second side of the cell and isolated from the interior of the conduit. The oxygen pumping mechanism may remove oxygen from an air flow within the interior of the intake conduit based on a voltage applied across the cell by the voltage source.

20 Claims, 3 Drawing Sheets

ENGINE HAVING OXYGEN PUMPING INTAKE SYSTEM AND METHOD OF REMOVING OXYGEN FROM INTAKE AIR FLOW

FIELD

The present disclosure relates to internal combustion engines, and more specifically to controlling oxygen levels in intake air flow in engines.

BACKGROUND

The statements in this section merely provide background information related to the present disclosure and may not constitute prior art.

Diesel engines typically have an unthrottled intake air flow. The air flow provided to the cylinders may have a greater amount of oxygen than is needed for combustion. These increased oxygen levels may result in increased nitrogen oxide ($NO_x$) and/or soot levels in the exhaust gas stream. The nitrogen oxide ($NO_x$) and/or soot levels may require additional exhaust aftertreatment components and exhaust gas recirculation systems to provide an exhaust gas flow that complies with federal regulations.

SUMMARY

An engine assembly may include an intake manifold in fluid communication with a combustion chamber, a voltage source, and a first oxygen pump assembly. The first oxygen pump assembly may include a first intake conduit and a first oxygen pumping mechanism. The first intake conduit may have an inlet in fluid communication with an air supply and an outlet in fluid communication with the intake manifold. The oxygen pumping mechanism may include an oxygen ion conducting cell, a first electrode in electrical communication with the voltage source and a second electrode in electrical communication with the voltage source. The first electrode may be disposed on a first side of the cell and may be exposed to an interior of the first intake conduit. The second electrode may be disposed on a second side of the cell and isolated from the interior of the conduit. The first oxygen pumping mechanism may remove oxygen from an air flow within the interior of the first intake conduit based on a voltage applied across the cell by the voltage source.

An engine air intake assembly may include a first intake conduit and a first oxygen pumping mechanism. The first intake conduit may have an inlet in fluid communication with an air supply and an outlet in fluid communication with an intake manifold of an engine. The first oxygen pumping mechanism may include a first oxygen ion conducting cell, a first electrode in electrical communication with a voltage source and a second electrode in electrical communication with the voltage source. The first electrode may be disposed on a first side of the cell and may be exposed to an interior of the first intake conduit. The second electrode may be disposed on a second side of the cell and isolated from the interior of the conduit. The first oxygen pumping mechanism may remove oxygen from an air flow within the interior of the first intake conduit based on a voltage applied across the cell by the voltage source.

A method of removing oxygen from an intake air flow may include providing an air supply to an intake manifold of an internal combustion engine. The air supply may be provided by a first intake conduit having an inlet in fluid communication with the air supply and an outlet in fluid communication with the intake manifold. The method may further include reducing an oxygen concentration of the air supplied to the intake manifold via a first oxygen pumping mechanism. The first oxygen pumping mechanism may include a first oxygen ion conducting cell, a first electrode in electrical communication with a voltage source and a second electrode in electrical communication with the voltage source. The first electrode may be disposed on a first side of the cell and may be exposed to an interior of the first intake conduit. The second electrode may be disposed on a second side of the cell and isolated from the interior of the conduit. The reducing may include applying a voltage across the cell from the voltage source to remove oxygen from the air within the interior of the first intake conduit.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
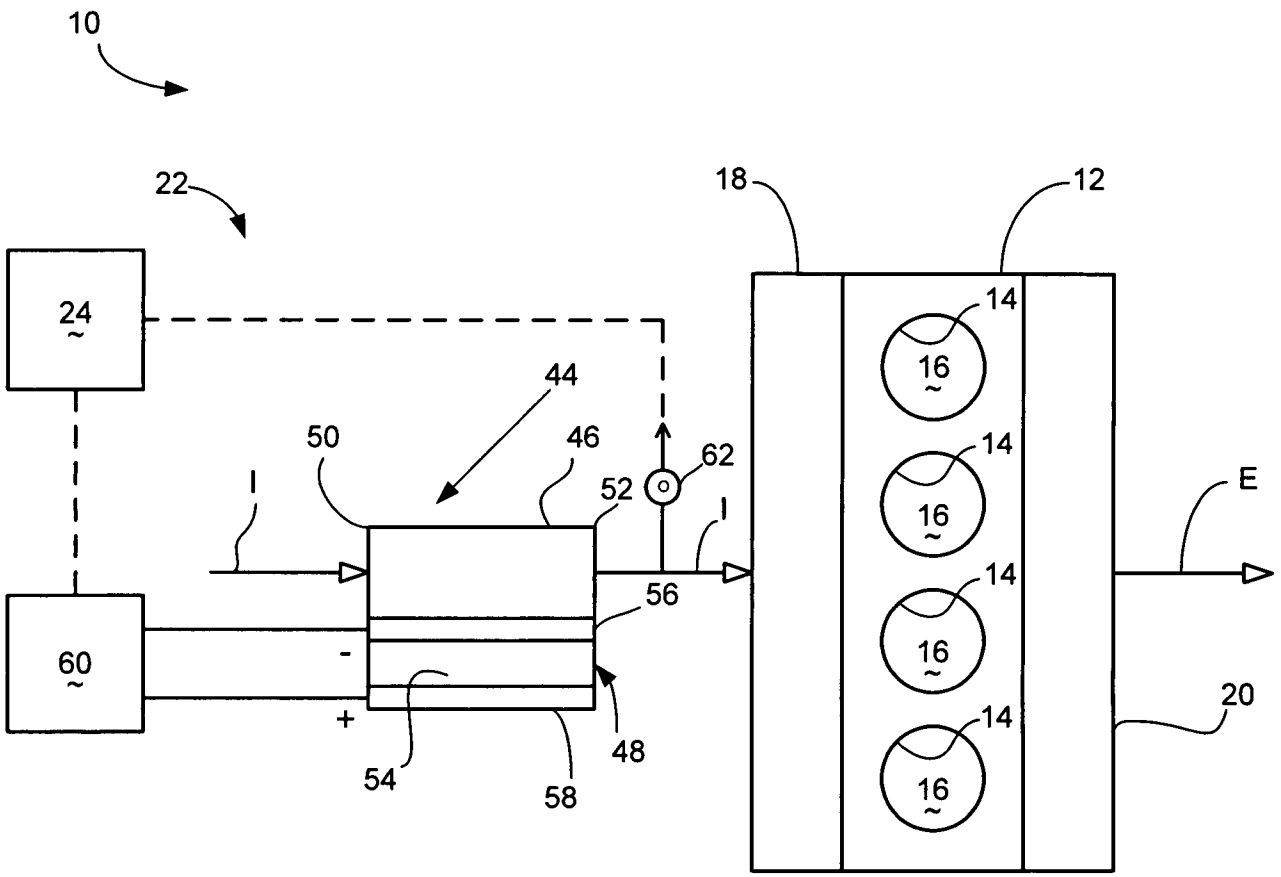
FIG. 1 is a schematic illustration of an engine assembly according to the present disclosure.

The following description is merely exemplary in nature and is not intended to limit the present disclosure, application, or uses. It should be understood that throughout the drawings, corresponding reference numerals indicate like or corresponding parts and features.

As seen in FIG. 1, an engine assembly 10 may include an engine structure 12 defining cylinders 14 having pistons 16 disposed therein, an intake manifold 18, an exhaust manifold 20, an air intake assembly 22 and a control module 24. It is understood that the present teachings apply to any number of piston-cylinder arrangements and a variety of engine configurations including, but not limited to, V-engines, inline engines, and horizontally opposed engines, as well as both overhead cam and cam-in-block configurations. The engine assembly 10 may include a diesel engine. However, it is understood that the present disclosure additionally applies to gasoline engines.

The pistons 16 and cylinders 14 may cooperate to define combustion chambers. The combustion chambers may be in fluid communication with the intake and exhaust manifolds 18, 20 via intake and exhaust valves (not shown). An intake air flow (I) may be provided by the intake manifold 18 and an exhaust gas flow (E) may exit the combustion chambers via the exhaust manifold 20.

The air intake assembly 22 may include an oxygen pump assembly 44 having an intake conduit 46 and an oxygen pumping mechanism 48. The intake conduit 46 may provide the intake air flow (I) to the intake manifold 18. The intake conduit 46 may include an inlet 50 in fluid communication with an intake air supply and an outlet 52 in fluid communication with the intake manifold 18. The oxygen pumping mechanism 48 may be located on a wall of the intake conduit 46 and may include an oxygen ion conducting cell 54, first and second electrodes 56, 58, and a voltage source 60. By way of non-limiting example, the oxygen ion conducting cell 54 may include an oxygen ion conducting solid electrolyte such as zirconium dioxide ($ZrO_2$). The first and second electrodes 56, 58 may each be porous structures formed from a material such as platinum. It is understood that the cell 54 and first and second electrodes 56, 58 are in no way limited to the materials discussed above and may be formed from a variety of materials according to procedures well established in the area of oxygen sensors.

The first electrode 56 may be located on a first side of the cell 54 and may be exposed to an interior of the intake conduit 46 and the second electrode 58 may be located on a second side of the cell 54 and may be exposed to an environment exterior to the intake conduit 46, such as the surrounding atmosphere. The first electrode 56 may be a negative electrode and the second electrode 58 may be a positive electrode. The first and second electrodes 56, 58 may each be in electrical communication with the voltage source 60. The control module 24 may be in communication with the voltage source 60 to control a voltage applied across the cell 54. As used herein, the term module may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

The volume of air within the intake conduit 46 may include oxygen. The voltage source 60 may apply a voltage across the cell 54 such that the first electrode 56 is negative and the second electrode 58 is positive. The direct current electric potential difference to be applied by the voltage source 60 may be a function of the temperature of the cell 54, as well as well as the properties and surface area of the cell 54 and the materials used for the first and second electrodes 56, 58. By way of non-limiting example, the voltage source 60 may include a vehicle battery as well as power inverters and associated components to boost the battery voltage and increase the ionic conductivity of the cell 54. More specifically, a power inverter may be used to generate high DC current, similar to hybrid vehicle applications.

Therefore, by way of non-limiting example, the voltage provided by the voltage source 60 may be greater than five volts (V), and more specifically greater than twelve volts (V). Based on the voltage applied across the cell 54, oxygen ions may be formed at the first electrode 56 and travel across the cell 54 to the second electrode 58, reducing the oxygen concentration in the volume of air within the intake conduit 46. The oxygen ions at the second electrode 58 may be released as oxygen molecules into the atmosphere (ambient air). The output of the voltage source 60 may be controlled based on a signal provided to the control module 24 from an oxygen sensor 62. The oxygen sensor 62 may be located downstream of the oxygen pump assembly 44. By way of non-limiting example, the oxygen sensor 62 may be in communication with an intake gas flow (I) exiting the oxygen pump assembly 44, as seen in FIG. 1. Alternatively, the oxygen sensor 62 may be in communication with an exhaust gas flow (E).

Figure 2:
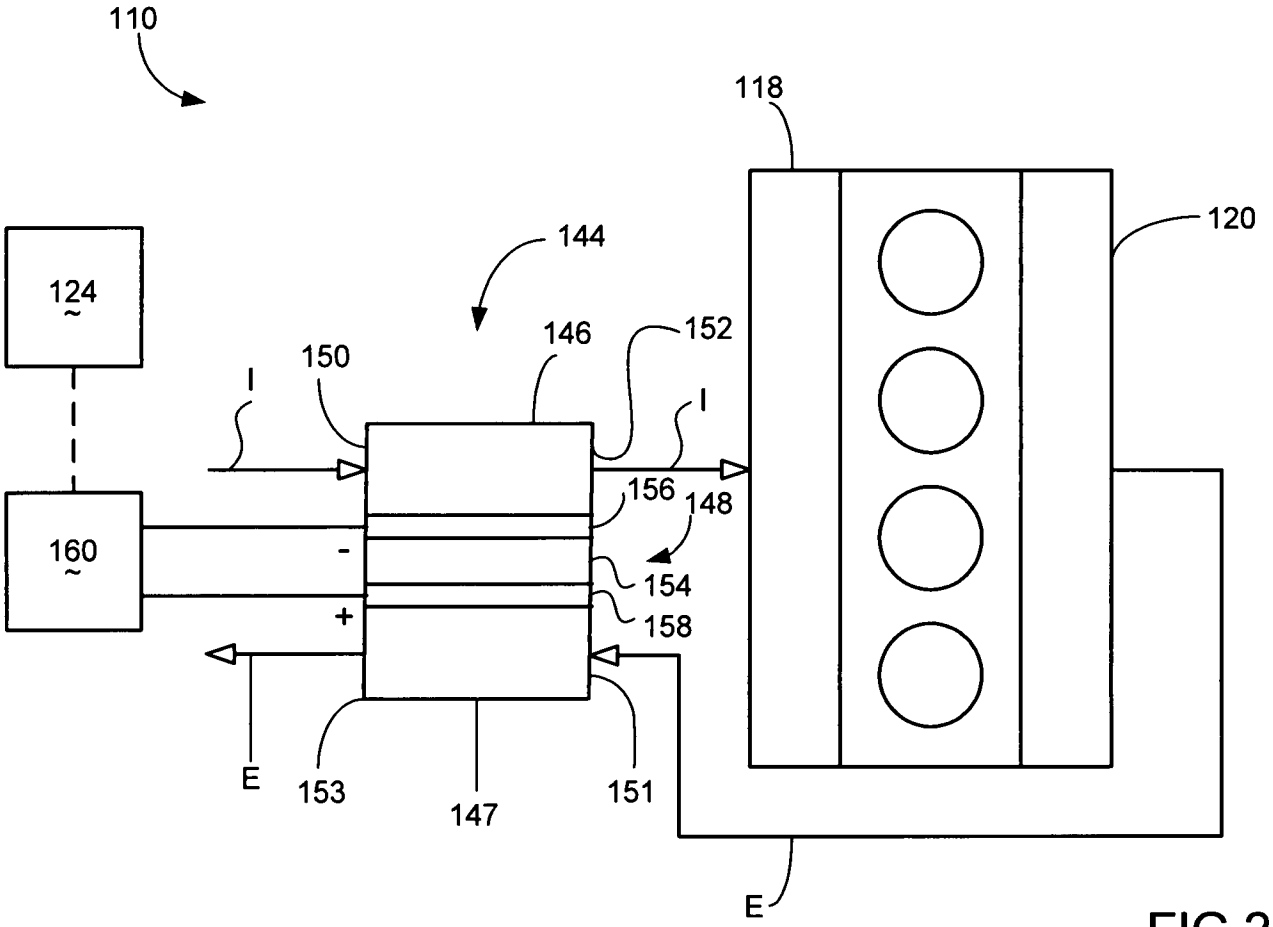
FIG. 2 is a schematic illustration of an alternate engine assembly according to the present disclosure.

An alternate engine assembly 110 is illustrated in FIG. 2. The engine assembly 110 may be generally similar to the engine assembly 10, with the exception of the oxygen pump assembly 144. It is understood that the description of the engine assembly 10 applies equally to the engine assembly 110, with the exceptions discussed below.

The oxygen pump assembly 144 may include an intake conduit 146, an exhaust conduit 147, and an oxygen pumping mechanism 148. The intake conduit 146 may provide the intake air flow (I) to the intake manifold 118. The intake conduit 146 may include an inlet 150 in fluid communication with an intake air supply and an outlet 152 in fluid communication with the intake manifold 118. The exhaust conduit 147 may extend adjacent to the intake conduit 146 and may include an inlet 151 in fluid communication with the exhaust manifold 120 and an outlet 153. The exhaust gas flow (E) exiting the exhaust manifold 120 may pass through the exhaust conduit 147. The intake and exhaust conduits 146, 147 may share a common wall defined by the oxygen pumping mechanism 148. The oxygen pumping mechanism 148 may include an oxygen ion conducting cell 154, first and second electrodes 156, 158, and a voltage source 160. The oxygen ion conducting cell 154 may be located between the interior volumes of the intake and exhaust conduits 146, 147. The exhaust gas flow (E) may heat the cell 154 to increase oxygen removal from the intake conduit 146. By way of non-limiting example, the oxygen ion conducting cell 154 may include an oxygen ion conducting solid electrolyte such as zirconium dioxide ($ZrO_2$). The first and second electrodes 156, 158 may each be porous structures formed from a material such as platinum.

The first electrode 156 may be located on a first side of the cell 154 and may be exposed to the interior of the intake conduit 146 and the second electrode 158 may be located on a second side of the cell 154 and may be exposed to an interior of the exhaust conduit 147. The first electrode 156 may be a negative electrode and the second electrode 158 may be a positive electrode. The first and second electrodes 156, 158 may each be in electrical communication with the voltage source 160. The control module 124 may be in communication with the voltage source 160 to control a voltage applied across the cell 154.

The volume of air within the intake conduit 146 may include oxygen gas. The voltage source 160 may apply a voltage across the cell 154 such that the first electrode 156 is negative and the second electrode 158 is positive. Based on the voltage applied across the cell 154, oxygen ions may be formed at the first electrode 156 and travel across the cell 154 to the second electrode 158, reducing the oxygen concentration in the volume of air within the intake conduit 146. The oxygen ions at the second electrode 158 may be released into the exhaust gas (E) within the exhaust conduit 147.

Figure 3:
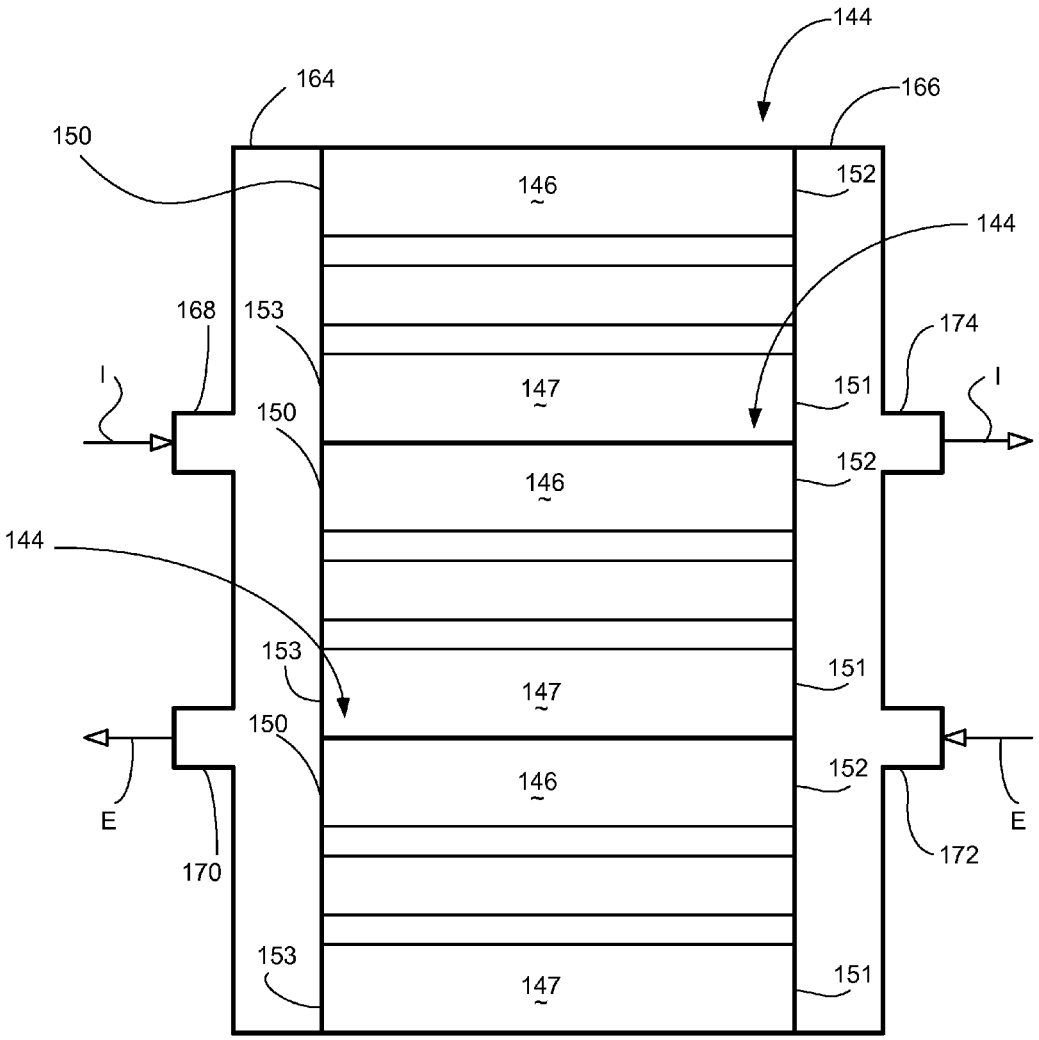
FIG. 3 is a schematic illustration of an alternate oxygen pump assembly according to the present disclosure.

While illustrated as including single oxygen pump assemblies 44, 144 in FIGS. 1 and 2, it is understood that a plurality of oxygen pump assemblies 44, 144 may be located in parallel with one another. A non-limiting example of the parallel arrangement is schematically illustrated in FIG. 3 using the oxygen pump assembly 144. However, it is understood that a similar arrangement may be used with the oxygen pump assembly 44.

As seen in FIG. 3, multiple oxygen pump assemblies 144 may be located in parallel to one another. A first manifold 164 may be located at a first end of the oxygen pump assemblies 144 and a second manifold 166 may be located at a second end of the oxygen pump assemblies 144. The first manifold 164 may include an inlet 168 and an outlet 170. The inlet 168 may provide a common inlet for communication between the intake air flow (I) and each of the inlets 150 of the intake conduits 146. The outlet 170 may provide a common outlet for exhaust gas flow (E) from each of the outlets 153 of the exhaust conduits 147. The second manifold 166 may include an inlet 172 and an outlet 174.

The inlet 172 may provide a common inlet for exhaust gas flow (E) to each of the inlets 151 of the exhaust conduits 147 from the exhaust manifold 120. The outlet 174 may be in fluid communication with the intake manifold 118 and may provide a common outlet for intake air flow (I) from each of the outlets 152 of the intake conduits 146.

What is claimed is:

1. An engine assembly comprising:

an intake manifold in fluid communication with a combustion chamber;

a first intake conduit having an inlet directly connected to an air supply and an outlet directly connected to said intake manifold;

a voltage source; and a first oxygen pump assembly disposed in said first intake conduit, the oxygen pump assembly including an oxygen ion conducting cell, a first electrode in electrical communication with the voltage source and a second electrode in electrical communication with the voltage source, the first electrode being disposed on a first side of the cell and being exposed directly to an interior of the first intake conduit, and the second electrode being disposed on a second side of the cell and isolated from the interior of the conduit, the first oxygen pump assembly disposed between the inlet and the outlet and configured to remove oxygen from an air flow within the interior of the first intake conduit based on a voltage applied across the cell by the voltage source to create an oxygen depleted airflow that is directly supplied to the intake manifold.

2. The engine assembly of claim 1, wherein the cell is formed from zirconium dioxide ($ZrO_2$).

3. The engine assembly of claim 1, wherein the voltage source is configured to apply a voltage across the cell of greater than 12 volts.

4. The engine assembly of claim 1, further comprising an exhaust manifold in fluid communication with the combustion chamber, the oxygen pump assembly including a first exhaust conduit in fluid communication with the exhaust manifold, the second electrode being exposed to an interior of the first exhaust conduit, the oxygen removed from the first intake conduit being provided to the first exhaust conduit.

5. The engine assembly of claim 4, wherein the first exhaust conduit is in thermal communication with the cell such that an exhaust gas provided to the first exhaust conduit from the exhaust manifold heats the cell to increase oxygen removal from the first intake conduit.

6. The engine assembly of claim 1, wherein the second electrode is exposed to atmosphere.

7. The engine assembly of claim 1, further comprising a second oxygen pump assembly having an inlet in fluid communication with an air supply and an outlet in fluid communication with the intake manifold, the second oxygen pump assembly being in a parallel orientation to the first oxygen pump assembly.

8. An engine air intake assembly comprising:

a first intake conduit having an inlet in fluid communication with an air supply and an outlet in direct fluid communication with an intake manifold of an engine; and a first oxygen pumping mechanism including a first oxygen ion conducting cell, a first electrode in electrical communication with a voltage source and a second electrode in electrical communication with the voltage source, the first electrode being disposed on a first side of the cell and being directly exposed to an interior of the first intake conduit, and the second electrode being disposed on a second side of the cell and isolated from the interior of the conduit, the first oxygen pumping mechanism disposed between the inlet and the outlet and configured to remove oxygen from an air flow within the interior of the first intake conduit based on a voltage applied across the cell by the voltage source, and to create an oxygen depleted airflow that is directly supplied to the intake manifold.

9. The engine air intake assembly of claim 8, wherein the cell is formed from zirconium dioxide ($ZrO_2$).

10. The engine air intake assembly of claim 8, wherein the voltage source is configured to apply a voltage across the cell of greater than 12 volts.

11. The engine air intake assembly of claim 8, further comprising an exhaust manifold, wherein the oxygen pumping mechanism includes a first exhaust conduit in fluid communication with the exhaust manifold, the second electrode being exposed to an interior of the first exhaust conduit, the oxygen removed from the first intake conduit being provided to the first exhaust conduit.

12. The engine air intake assembly of claim 11, wherein the first exhaust conduit is in thermal communication with the first intake conduit such that an exhaust gas within the first exhaust conduit heats the cell to increase oxygen removal from the first intake conduit.

13. The engine air intake assembly of claim 8, wherein the second electrode is exposed to atmosphere.

14. The engine air intake assembly of claim 8, further comprising:

a second intake conduit in a parallel orientation to the first intake conduit and having an inlet in fluid communication with the air supply and an outlet in fluid communication with the intake manifold of the engine; and a second oxygen pumping mechanism including a second oxygen ion conducting cell, a third electrode in electrical communication with the voltage source and a fourth electrode in electrical communication with the voltage source, the third electrode being disposed on a first side of the second cell and being exposed to an interior of the second intake conduit and the fourth electrode being disposed on a second side of the second cell and isolated from the interior of the second intake conduit, the second oxygen pumping mechanism removing oxygen from an air flow within the interior of the second intake conduit based on a voltage applied across the second cell by the voltage source.

15. A method comprising:

providing an air supply to an intake manifold of an internal combustion engine, the air supply being provided by a first intake conduit having an inlet in fluid communication with the air supply and an outlet directly in fluid communication with the intake manifold; and reducing an oxygen concentration of the air supplied to the intake manifold via a first oxygen pumping mechanism, the first oxygen pumping mechanism including a first oxygen ion conducting cell, a first electrode in electrical communication with a voltage source and a second electrode in electrical communication with the voltage source, the first electrode being disposed on a first side of the cell and being exposed to an interior of the first intake conduit and the second electrode being disposed on a second side of the cell and isolated from the interior of the conduit, the reducing including applying a voltage across the cell from the voltage source to remove oxygen from the air within the interior of the first intake conduit that is supplied directly to the intake manifold.

16. The method of claim 15, wherein the reducing the oxygen concentration includes removing oxygen from a second intake conduit via a second oxygen pump mechanism, the second intake conduit being in a parallel orientation relative to the first intake conduit and including a second inlet in fluid communication with the air supply and a second outlet in fluid communication with the intake manifold, the second oxygen pumping mechanism including a second oxygen ion conducting cell, a third electrode in electrical communication with the voltage source and a fourth electrode in electrical communication with the voltage source, the third electrode being disposed on a first side of the second cell and being exposed to an interior of the second intake conduit and the fourth electrode being disposed on a second side of the second cell and isolated from the interior of the second intake conduit, the second oxygen pumping mechanism removing oxygen from an air flow within the interior of the second intake conduit based on a voltage applied across the second cell by the voltage source.

17. The method of claim 15, wherein the voltage applied across the cell from the voltage source is greater than 12 volts.

18. The method of claim 15, further comprising providing an exhaust gas flow from an exhaust manifold of the internal combustion engine to a first exhaust conduit, the second electrode being exposed to an interior of the first exhaust conduit and the oxygen removed from the first intake conduit being provided to the first exhaust conduit.

19. The method of claim 18, wherein the exhaust gas flow provided to the first exhaust conduit heats the cell to increase a rate of oxygen removal from the first intake conduit.

20. The method of claim 15, wherein the second electrode is exposed to atmosphere, the oxygen removed from the first intake conduit being provided to the atmosphere by the voltage applied across the cell.

* * * * *